US009420386B2

(12) United States Patent
Rass

(10) Patent No.: US 9,420,386 B2
(45) Date of Patent: Aug. 16, 2016

(54) METHOD FOR ADJUSTING A HEARING DEVICE APPARATUS AND HEARING DEVICE APPARATUS

(71) Applicant: SIVANTOS PTE. LTD., Singapore (SG)

(72) Inventor: Uwe Rass, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 494 days.

(21) Appl. No.: 13/857,302

(22) Filed: Apr. 5, 2013

(65) Prior Publication Data

US 2014/0016788 A1 Jan. 16, 2014

Related U.S. Application Data

(60) Provisional application No. 61/620,490, filed on Apr. 5, 2012.

(51) Int. Cl.
*H04R 25/00* (2006.01)

(52) U.S. Cl.
CPC ..... *H04R 25/552* (2013.01); *H04R 25/70* (2013.01); *H04R 2225/61* (2013.01); *H04R 2430/01* (2013.01); *H04S 2420/01* (2013.01)

(58) Field of Classification Search
CPC .. H04R 25/70; H04R 25/552; H04R 2225/70; H04R 2420/01; H04R 2225/61; H04R 2430/00; H04S 2420/01
USPC ..... 381/23.1, 60, 74, 312, 313, 315
See application file for complete search history.

(56) References Cited

U.S. PATENT DOCUMENTS

| | | | | |
|---|---|---|---|---|
| 5,012,520 | A | 4/1991 | Steeger | |
| 5,785,661 | A * | 7/1998 | Shennib | 600/559 |
| 6,236,732 | B1 * | 5/2001 | Griffith | H04R 1/1008 381/370 |
| 7,142,681 | B2 | 11/2006 | Kortekaas | |
| 7,295,676 | B2 | 11/2007 | Chalupper | |
| 7,415,123 | B2 * | 8/2008 | Ballas | 381/309 |
| 7,561,707 | B2 | 7/2009 | Kornagel | |
| 8,666,080 | B2 * | 3/2014 | Hain et al. | 381/17 |
| 2001/0046304 | A1 * | 11/2001 | Rast | H04R 1/1041 381/74 |

(Continued)

FOREIGN PATENT DOCUMENTS

| | | |
|---|---|---|
| DE | 103 05 830 B3 | 10/2004 |
| DE | 103 51 509 A1 | 6/2005 |

(Continued)

*Primary Examiner* — David Ton

(74) *Attorney, Agent, or Firm* — Laurence A. Greenberg; Werner H. Stemer; Ralph E. Locher

(57) ABSTRACT

The aim 1s to make operation of hearing device apparatuses more convenient. A method is proposed for operating a hearing device apparatus by a user by presenting a first acoustic signal by the hearing device apparatus as originating from a first virtual position and by presenting a second acoustic signal by the hearing device apparatus as originating from a second virtual position. In this connection the first acoustic signal represents a first adjustment option of the hearing device apparatus and the second acoustic signal a second adjustment option. The body part of the user is moved toward the first or second virtual position and a position or movement of the body part of the user is detected. Finally the detected position or movement of the body part is automatically allocated to the first or second virtual position, whereby the adjustment option corresponding to the allocated virtual position is chosen.

10 Claims, 2 Drawing Sheets

(56) References Cited

U.S. PATENT DOCUMENTS

| | | | | |
|---|---|---|---|---|
| 2002/0003889 | A1* | 1/2002 | Fischer | H04R 1/1041 381/370 |
| 2003/0059070 | A1* | 3/2003 | Ballas | 381/309 |
| 2006/0018497 | A1* | 1/2006 | Kornagel | 381/315 |
| 2006/0215847 | A1* | 9/2006 | Hollemans | H04R 1/1041 381/74 |
| 2007/0127750 | A1* | 6/2007 | Glatt et al. | 381/312 |
| 2007/0160242 | A1* | 7/2007 | Cadalli et al. | 381/312 |
| 2009/0116652 | A1* | 5/2009 | Kirkeby et al. | 381/1 |
| 2009/0116657 | A1* | 5/2009 | Edwards et al. | 381/60 |
| 2010/0150355 | A1* | 6/2010 | Kon et al. | 381/17 |

FOREIGN PATENT DOCUMENTS

| | | | |
|---|---|---|---|
| EP | 0340594 | A1 | 11/1989 |
| EP | 1 619 928 | A1 | 1/2006 |

* cited by examiner

METHOD FOR ADJUSTING A HEARING DEVICE APPARATUS AND HEARING DEVICE APPARATUS

CROSS-REFERENCE TO RELATED APPLICATION

This application claims the priority, under 35 U.S.C. §119 (e), of provisional application No. U.S. 61/620,490 filed Apr. 5, 2012; the prior application is herewith incorporated by reference in its entirety.

BACKGROUND OF THE INVENTION

Field of the Invention

The present invention relates to a method for operating a hearing device apparatus by a user. The present invention also relates to a hearing device apparatus for a user having a first hearing device, a second hearing device and optionally at least one further device. A hearing device apparatus is here taken to mean any device which can be worn in or on the ear and fulfills a hearing aid function, in particular a binaural hearing system.

Hearing devices are wearable hearing apparatuses that are used to support the hard of hearing. Different hearing device designs, such as behind-the-ear hearing devices (BTE), hearing devices with an external receiver (RIC: receiver in the canal) and in-the-ear hearing devices (ITE), for example also concha hearing devices or completely-in-canal hearing devices (ITE, CIC) are provided in order to accommodate the numerous individual requirements. The hearing devices listed by way of example are worn on the outer ear or in the auditory canal. However, bone conduction hearing aids, implantable or vibrotactile hearing aids are also commercially available, moreover. In this case damaged hearing is either mechanically or electrically stimulated.

In principle hearing devices have as their fundamental components an input converter, an amplifier and an output converter. The input converter is usually a sound pick-up, for example a microphone and/or an electromagnetic receiver, for example an induction coil. The output converter is usually implemented as an electroacoustic converter, for example a miniature loudspeaker, or as an electromechanical converter, for example a bone conduction receiver. The amplifier is conventionally integrated in a signal processing unit. This basic construction is shown in FIG. 1 using the example of a behind-the-ear hearing device. One or more microphone(s) 2 for receiving the sound from the environment are fitted in a hearing device housing 1 for wearing behind the ear. A signal processing unit 3, which is also integrated in the hearing device housing 1, processes the microphone signals and amplifies them. The output signal of the signal processing unit 3 is transmitted to a loudspeaker or receiver 4 which outputs an acoustic signal. The sound is optionally transmitted via a sound tube, which is fixed to an otoplastic in the auditory canal, to the eardrum of the wearer of the device. The energy supply to the hearing device, and in particular that of the signal processing unit 3, takes place by way of a battery 5 likewise integrated in the hearing device housing 1.

Numerous electronic devices have a plurality of adjustment options. To be able to present the user with the adjustment options they are frequently presented visually in a menu structure. A touchscreen by way of example, which is used for example in the case of what are known as smartphones for menu control, serves as the user interface for operating the menu. In this connection options are chosen by gestures or swiping movements on the screen.

Hearing devices do not have correspondingly designed surfaces, however, in order to be able to detect such gestures or swiping movements. Nevertheless it would be desirable if hearing devices could also be intuitively controlled by gestures.

Furthermore, smartphones offer the options of inputting text or telephone numbers by speech recognition. The user has to activate the device with the aid of the touchscreen for this purpose as well, however.

Furthermore, it is known to actuate hearing devices using what is known as a "toggle" or a pushbutton on the device, but it is also known to use remote control. A hearing device program for example can be chosen in this way. Some devices reproduce the chosen program number or function for the user by speech.

A hearing aid or communication system with virtual signal sources is known from published, European patent application EP 1 619 928 A1. This should allow the user of this system to more easily allocate or distinguish acoustic signals produced in the system to provide the user with information about current settings or states of the system. For this purpose the signal is emitted by the hearing aid or communication system in such a way that for the user the signals seem to come from different signal sources in the space surrounding the user. The acoustic signals consequently carry additional information which can be consciously or unconsciously perceived by the user.

SUMMARY OF THE INVENTION

It is accordingly an object of the invention to provide a method for adjusting a hearing device apparatus and a hearing device apparatus, which overcome the above-mentioned disadvantages of the prior art devices of this general type, which makes operation of the hearing device apparatus more convenient.

According to the invention the object is achieved by a method for operating a hearing device apparatus by a user. The method includes presenting a first acoustic signal by use of the hearing device apparatus as originating from a first virtual position, wherein the first acoustic signal represents a first adjustment option of the hearing device apparatus, and presenting a second acoustic signal by use of the hearing device apparatus as originating from a second virtual position. The second acoustic signal represents a second adjustment option of the hearing device apparatus. A body part of the user is moved toward the first or second virtual position. A position or movement of the body part of the user is detected. Automatic allocation occurs of the detected position or movement of the body part toward the first or second virtual position, whereby the adjustment option corresponding to the allocated virtual position is chosen.

Also provided according to the invention is a hearing device apparatus for a user. The hearing device apparatus has a first hearing device, a second hearing device and optionally at least one further device. The hearing devices, optionally together with the at least one further device, are constructed to present a first acoustic signal as originating from a first virtual position, the first acoustic signal represents a first adjustment option of the hearing device apparatus. The hearing devices, optionally together with the at least one further device, further present a second acoustic signal as originating from a second virtual position, wherein the second acoustic signal represents a second adjustment option of the hearing device apparatus. The components detect a position or movement of a body part of the user, and automatically allocate the detected position or movement of the body part toward the first or second virtual position, whereby the adjustment option corresponding to the allocated virtual position is chosen.

A plurality of adjustment options is therefore advantageously acoustically presented to a user in that representatives of the respective settings are produced as a sound stimulus from different spatial positions. A location in space is consequently allocated to each adjustment option. This location can then be easily and intuitively indicated by positioning, orienting or moving a body part. This indicating may be automatically detected and be allocated the respective adjustment option. This provides a very convenient selection possibility of adjustment options of the hearing device apparatus.

The first and second acoustic signals are preferably produced with the aid of a head-related transfer function. Such a head-related transfer function ensures that the acoustic influences of the head of the user are taken into consideration when producing the acoustic signals. The acoustic signals can therefore be more reliably provided as originating from a certain direction.

Provision of each of the acoustic signals can be initiated by actuating an actuation element, moving a body part or detecting a key word spoken by the user. This means that the acoustic signal is presented at precisely the instant where the user requests this by way of an action he carries out himself.

It is particularly advantageous if the position or movement of the body part is detected with the aid of the earth's magnetic field. Relative movements may be reliably detected by way of example independently of visual conditions with the aid of the earth's magnetic field. Alternatively, however, other sensors may also be used. Acceleration sensors by way of example can therefore detect movements of a body part.

Automatic allocation of the detected position or movement of the body part to one of the virtual positions can be initiated by actuating an actuation element, moving a body part or detecting a key word spoken by the user. The end of the selection process can therefore be initiated by a user action in addition to presentation of an acoustic signal, whereby, finally, the automatic allocation process is initiated.

The body part of the user can be his head. The user can therefore select the available adjustment options by turning or lifting or lowering his head.

Alternatively the body part of the user may also be one of his hands or fingers. The user can therefore choose a specific adjustment option by way of example by pointing in a direction or by swiping and the like.

It is particularly preferred if the choice of the adjustment option is made by the user turning his head in a certain direction, which represents his chosen adjustment option, and he then confirms his choice by a nod of his head, whereby the corresponding adjustment option is deemed chosen. The user can therefore choose his desired adjustment option using simple head movements even by way of example in situations where he does not have a hand free to choose an adjustment option.

One of the adjustment options can relate to a hearing device program, loudness, pitch, direction characteristic, noise suppression, hearing content or the like. Basically, any parameter which may be adjusted on a hearing device or hearing system can be chosen by way of the inventive acoustic mode of presentation.

Other features which are considered as characteristic for the invention are set forth in the appended claims.

Although the invention is illustrated and described herein as embodied in a method for adjusting a hearing device apparatus and a hearing device apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in more detail below are preferably embodiments of the present invention.

Figure 1:
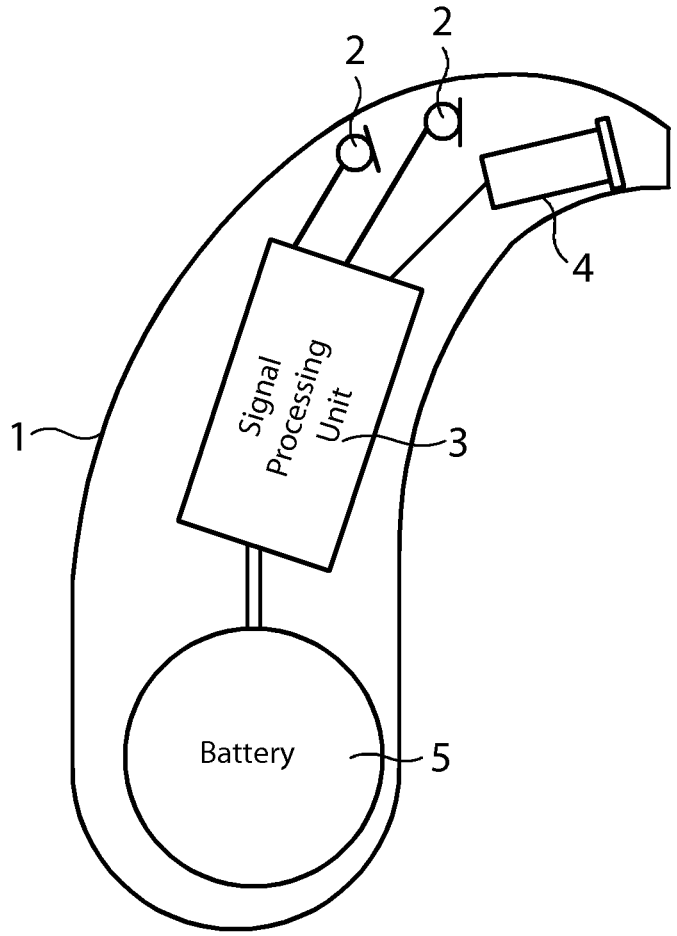
FIG 1 PRIOR ART
FIG. 1 is an illustration showing the basic construction of a hearing device according to the prior art.
Figure 2:
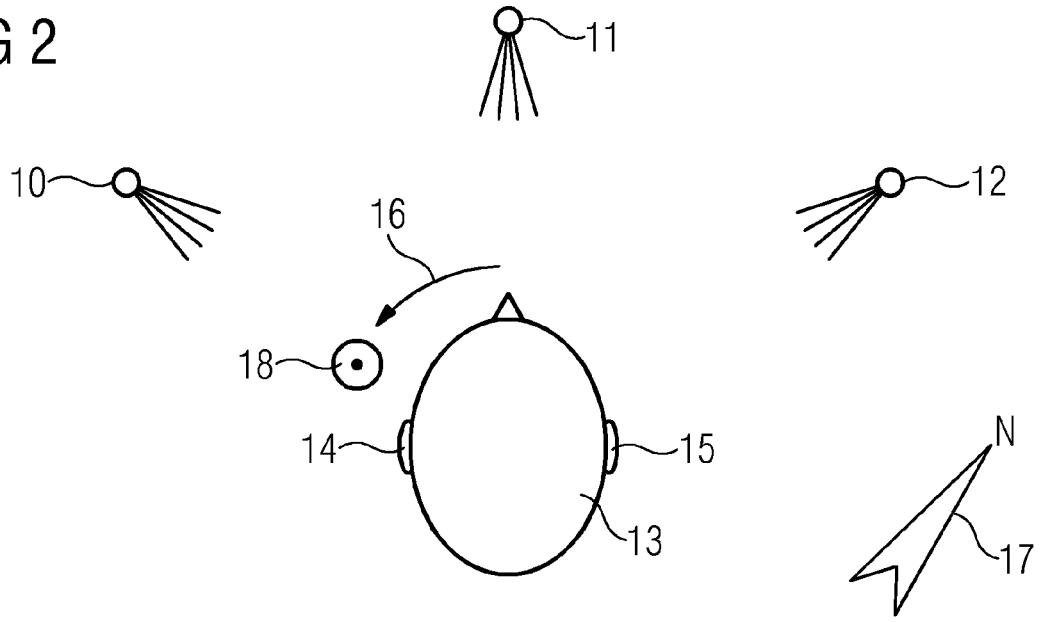
FIG. 2 is an illustration showing a schematic view for acoustic, spatial presentation of a selection menu.

Touch screens typically show what are referred to as icons or options which can be chosen using a finger. If, however, as in the case of hearing devices or hearing device apparatuses, there is no screen available, or the user is not able to see it, the options according to FIG. 2 are acoustically presented. To be able to distinguish between the selectable options the acoustic signals or their sources 10, 11 and 12 are positioned virtually around the user 13. The signals are presented by two hearing devices 14, 15 here which assist the user 13 binaurally.

To position the sources 10 to 12 virtually at the desired locations it is necessary to reproduce the acoustic conditions at the head of the user. It is only in this way that acoustic signals may be produced which the user also perceives as emanating from a certain direction. As a rule, what is known as a head related transfer function (HRTF) is sufficient for this purpose.

In a specific example the user 13 should have three adjustment options. Therefore when representing the three adjustment options three acoustic signals 10, 11 and 12 are presented from different directions. This direction-dependent presentation is made by the two hearing devices 14, 15, using which the impression can be given to the user 13 that a first acoustic signal 10 is coming from the front left, a second acoustic signal 11 is coming from the front center and a third acoustic signal 12 is coming from the front right. To achieve this virtual positioning of sound sources the two hearing devices 14, 15 are preferably coupled to each other by a wireless data link.

Presentation of the individual acoustic signals 10 to 12 is made successively and is initiated in each case by active involvement of the user. Presentation is therefore triggered by user interactions. Triggering can occur by way of example by pressing a button, by saying a key word which can be identified by a speech recognition algorithm or by a user gesture which can be detected.

Three options are selected in the above example. The number of options for adjusting the hearing device apparatus with the two hearing devices 14 and 15 may also be two or be greater than three, however. The half space in front of the user 13 is then preferably directionally divided into a corresponding number of sectors in which the virtual sound waves are arranged. The sectors are preferably roughly the same size.

Figure 3:
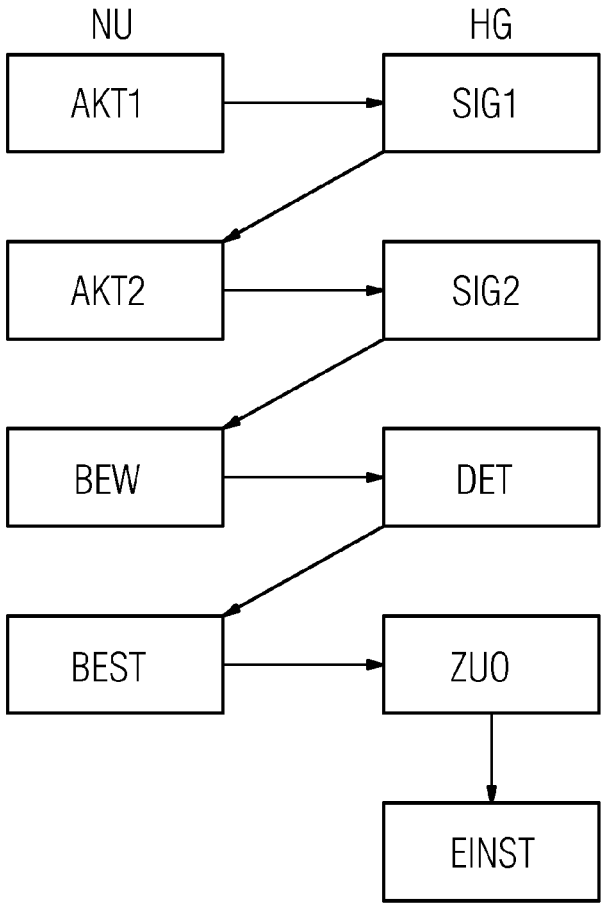
FIG. 3 is a flow chart showing an exemplary course of a method according to the invention.

An example of the inventive method will be illustrated in connection with FIG. 3. The left-hand side of FIG. 3 shows in this respect the actions which the user NU has to perform, and the right-hand side the method steps which take place in the hearing device or hearing device apparatus HG. The user NU wants to adjust his hearing device apparatus HG therefore. For this purpose he initiates the adjustment process with a first action AKT1. This action AKT1 may be the pressing of a button on one of the hearing devices 14, 15 or a remote control, but may also be by way of example a key word which the user NU or 13 speaks and is detected by the hearing device apparatus by way of speech recognition.

The entire adjustment procedure and/or presentation of a first option is/are initiated by the hearing device apparatus HG due to the first action AKT1. Specifically therefore, reproduction of an acoustic signal 10 is triggered from a virtual position front left by way of example by pressing a button. In other words, acoustic reproduction occurs by way of the two hearing devices 14 and 15 in such a way that the relevant sound seems to come from the direction or position front left. The hearing device apparatus HG, triggered by the action AKT1 of the user NU, therefore executes presentation/generation of the first acoustic signal SIG1.

The user NU then performs a second action AKT2 (for example push of a button, speaking a key word, etc.). The hearing device apparatus HG then emits a second acoustic signal SIG2. To the user NU or 13 this seems to originate from a different direction or from a different virtual position. The signal SIG2 is by way of example the acoustic signal 11 which seems to arrive from the front, relative to the head of the user 13 (see FIG. 2). One or more such pair(s) of steps optionally then follow(s) which consist(s) of an action of the user NU and a signal output by the hearing device apparatus HG.

At the end of or with acoustic presentation of all adjustment options the user performs a further action which in this case consists of a head movement BEW, which is identified in FIG. 2 by the arrow 16. During this movement BEW the user NU moves his head or another body part, such as an arm or a hand, in the direction or toward the virtual position which he perceived during presentation of the individual options or in which he receives the desired presentation. The hearing device apparatus has to then be able to register this movement of the head. A corresponding detection step is necessary for this purpose.

Detection is based by way of example on the basis of the earth's magnetic field 17. For this purpose the hearing device apparatus with the two hearing devices 14 and 15 and optionally one or more additional apparatus(s) (for example remote control, induction strip, etc.) firstly registers the virtual positions or directions of the first acoustic signal 10, second acoustic signal 11, etc. in relation to the earth's magnetic field 17 (north pole N). If the user 13 then turns his head this can be detected with the aid of the hearing device apparatus HG.

If the user NU then wants to choose one of the adjustment options, he then has to make a corresponding confirmation BEST in addition to moving or turning his body part in the relevant direction or toward the relevant virtual position. In a simple case the user 13 according to FIG. 2 therefore turns by way of example his head according to arrow 16 to the left toward the virtual direction or position from which the first acoustic signal 10 arrives, and he then nods with his head according to symbol 18. The hearing device apparatus HG, initiated by this nod, registers the direction or position of the head of the user 13 and allocates the detected position or direction to the corresponding adjustment option which is represented by the chosen virtual direction of sound incidence. A corresponding adjustment EINST is then made in the hearing device apparatus HG with the aid of this allocation. The adjustment is made therefore in the hearing device apparatus which corresponds to the selected adjustment option. A certain hearing device program (for example for a telephone situation, for speech in a quiet atmosphere), etc. or simply the adjustment of the loudness is selected/made in several stages. Other adjustments, such as the gradual adjustment of noise suppression or various direction characteristics may also be made, however, by way of the acoustic menu selection.

The choice of options can be made in different ways. Acceleration and/or position sensors by way of example can be used therefore. Alternatively the option selection may also be made by manual operation.

When using an acceleration and/or position sensor this may be implemented on the head of the user (e.g. in one of the hearing devices) or on the hand of the user (e.g. as a ring or wrist band) or even in the hand (e.g. as a pen which is held).

A further exemplary embodiment will be illustrated below in which the steps of movement of a body part, detection of the position or movement of the body part and automatic allocation to an adjustment option take place before processing of the acoustic signals.

An acceleration sensor detects a movement, e.g. if the head is moved to the right. Position sensors detect the orientation by way of example in relation to the earth's magnetic field, as described above. If, by way of example, two wireless audio sources are available to the user in a space (e.g. television and stereo system), the television audio signal by way of example is presented virtually on the left-hand side of the user and the audio signal of the stereo system is presented on the right-hand side (preferably successively triggered by an appropriate trigger action). If the user then turns his head to the left the sensors detect the movement, and the audio signal of the television is presented binaurally. If, on the other hand, the head is moved to the right, the audio signal of the stereo system is presented binaurally. In order to accordingly choose one of the two sources the user turns his head to the corresponding side and nods with his head by way of example. The acceleration sensors will detect this actuation signal and select the respective audio source for further presentation.

The same selection principle may be implemented if the sensor or sensors are fitted on the hand of the user. The corresponding audio source is presented as the selection option by way of gestures, such as swiping movements, to the left or right. The swiping movement or gesture can be made in the air without a specific sensor surface being required. A confirmation gesture (e.g. nodding) confirms the selection of the acoustic signal or adjustment option made. Confirmation or the confirmation movement can be detected by the same sensors as also detect the movement of the body part of the user with which the choice of respective adjustment options is to be indicated.

Other options may be chosen in this way instead of choosing the audio sources. Examples of this, as already mentioned above, are: selection of a hearing program in the hearing devices, loudness upwards/downwards and noise reduction settings specifically for controlling a beamformer.

According to a further embodiment the choice of an adjustment option can also be made using what is known as a "touchpad", as is known in the case of notebooks, or by way of a conventional touchscreen (as is typically known in the case of smartphones or tablet computers). In this case the hearing device apparatus comprises a touchpad or a touchscreen. As in the example above, acoustic presentation of the options is again made here, instead of visual presentation of the options on a screen. This is advantageous in particular for people who suffer from sight impairment or are even blind. A system of this kind may also be advantageous in situations where the user is not able to look at a screen (e.g. while driving).

In this exemplary embodiment the moved body part is then a finger of the user which points toward the first or second virtual position or moves in a corresponding direction. The position or movement of the finger is then detected with the aid of the touchpad or touchscreen and a corresponding allocation to the respective adjustment option is made. A double click or single click can serve as confirmation in this case.

The features of the above embodiments can be combined with each other as desired.

In accordance with the present invention the choice of options on a hearing device apparatus or a hearing device is therefore enabled on the basis of bodily gestures and virtual acoustic presentation of the options. The advantage of this is improved accessibility and usefulness of modern hearing devices. These advantages are beneficial in particular for people with visual impairment or limited motor skills. The choice of options is made automatically by sensors which are situated in hearing devices or other apparatuses worn on the body.

The invention claimed is:

1. A method for operating a hearing device apparatus via a user, which comprises the steps of:

performing a first step by initiating presentation of each of a first and a second acoustic signals by actuating an actuation element, moving a body part or detecting a key word spoken by the user;

performing a second step by presenting the first acoustic signal by means of the hearing device apparatus as originating from a first virtual position, the first acoustic signal represents a first adjustment option of the hearing device apparatus;

subsequently performing a third step by presenting the second acoustic signal by means of the hearing device apparatus as originating from a second virtual position, the second acoustic signal represents a second adjustment option of the hearing device apparatus;

after performing the first to the third steps, performing a fourth step by moving a body part of the user toward the first or second virtual position;

performing a fifth step by detecting a position or movement of the body part of the user; and performing a sixth step by automatically allocating a detected position or movement of the body part toward the first or second virtual position, whereby a predetermined adjustment option applied to the hearing device apparatus corresponding to an allocated virtual position is chosen.

2. The method according to claim 1, which further comprises producing the first and second acoustic signals with an aid of a head-related transfer function.

3. The method according to claim 1, which further comprises detecting the position or the movement of the body part with an aid of earth's magnetic field.

4. The method according to claim 1, which further comprises initiating an automatic allocation by actuating an actuation element, moving the body part or detecting a key word spoken by the user.

5. The method according to claim 4, wherein the movement of the body part is a nod of a head of the user.

6. The method according to claim 1, wherein the body part of the user is his head.

7. The method according to claim 1, wherein the body part of the user is one of his hands.

8. The method according to claim 1, wherein the adjustment option is selected from the group consisting of a hearing device program, loudness, pitch, direction characteristic, noise suppression and a hearing content.

9. A hearing device apparatus for a user, the hearing device apparatus comprising:

a first hearing device;

a second hearing device;

said first and second hearing devices are constructed to:

perform a first step by presenting a first acoustic signal as originating from a first virtual position, the first acoustic signal representing a first adjustment option of the hearing device apparatus after the user initiating presentation of the first acoustic signal by actuating an actuation element, moving a body part or speaking a key word;

perform a second step by presenting a second acoustic signal as originating from a second virtual position, the second acoustic signal represents a second adjustment option of the hearing device apparatus after the user initiating presentation of the second acoustic signal;

after performing the first and second steps, perform a third step by detecting a position or movement of a body part of the user; and perform a fourth step by automatically allocating a detected position or movement of the body part toward the first or second virtual position, whereby a predetermined adjustment option applied to the hearing device apparatus corresponding to an allocated virtual position is chosen.

10. The hearing device apparatus according to claim 9, further comprising at least one further device programmed to assist said first and second hearing devices to perform the steps recited in claim 9.

* * * * *